United States Patent [19]

Chaix et al.

[11] 4,219,080

[45] Aug. 26, 1980

[54] PLATE-TYPE HEAT EXCHANGER

[75] Inventors: Jean-Edmond Chaix, Manosque; Maurice Fajeau, Pertuis; Paul Madamour; Christian Masnou, both of Paris, all of France

[73] Assignees: Commissariat a l'Energie Atomique; Fives-Cail Babcock, both of Paris, France

[21] Appl. No.: 904,219

[22] Filed: May 9, 1978

[30] Foreign Application Priority Data

May 16, 1977 [FR] France ..... 77 14887

[51] Int. Cl.[3] ..... F28F 3/02

[52] U.S. Cl. ..... 165/166; 165/173

[58] Field of Search ..... 285/133 R; 165/165–167, 140, 145, 82, 170, 173

[56] References Cited

U.S. PATENT DOCUMENTS

| | | | |
|---|---|---|---|
| 1,853,000 | 4/1932 | Hansen | 165/157 |
| 2,712,438 | 7/1955 | Brown, Jr. | 285/133 R |
| 2,959,400 | 11/1960 | Simpelaar | 165/166 |
| 3,635,287 | 1/1972 | Sprague | 165/140 |

FOREIGN PATENT DOCUMENTS

| | | | |
|---|---|---|---|
| 773543 | 9/1934 | France | 165/130 |

*Primary Examiner*—Samuel Scott
*Assistant Examiner*—Theophil W. Streule, Jr.
*Attorney, Agent, or Firm*—Kerkam, Stowell, Kondracki & Clarke

[57] ABSTRACT

The plate exchanger comprises a plurality of flat parallel compartments formed between adjacent plates which are maintained in spaced relation by means of rings each having a T-shaped cross-section. The side arms of the T are welded to opposite edges of orifices formed in adjacent plates and the outwardly directed stem of the T is disposed between the plates. The interior of the array of spacer rings forms a header for the low-pressure fluid which flows through the compartments and a cylindrical tube extends through all the spacer rings in order to serve as an internal support.

9 Claims, 6 Drawing Figures

PLATE-TYPE HEAT EXCHANGER

This invention relates to a plate-type heat exchanger comprising a plurality of parallel flat compartments each delimited between two adjacent plates, said compartments being separated by narrow spaces. During normal operation, a fluid at high pressure circulates within said spaces and exchanges heat across the plates with another fluid at low pressure which flows through the compartments. In the following description, the high-pressure and low-pressure fluids will be designated respectively as the HP fluid and the LP fluid.

Many designs of plate exchangers of the type mentioned above are already known. In one particular design, compartments arranged within an outer shell are connected in parallel to inlet and outlet headers respectively for the admission and discharge of the fluid which flows through the compartments. The heat-exchanger shell is connected to an inlet duct and an outlet duct for the admission and discharge of the other fluid which circulates within the spaces between the compartments. Preferably, the plates constituting the compartments are provided at the periphery with elbowed edges so arranged that the assembly of these plates in pairs form each compartment. In addition, said plates are each provided with at least two separate orifices having an extension end element constituted by a flared portion of the corresponding plate and extending at right angles to the plane of said plate. The compartments are formed by welding the plates in edge-to-edge relation and are thus supplied through the header formed by said end elements which are suitably disposed from one plate to the next in the line of extension of each other. A design of this type has been described and claimed in particular in French Pat. No. 2,131,791 of Feb. 23, 1971 in the name of the company known as Babcock Atlantique.

The present invention relates to an improvement in the arrangements recalled in the foregoing, especially in regard to the application of means for optimizing the relative spacing of the compartments within the spaces provided for the circulation of the HP fluid independently of the width of said compartments and for providing a more reliable connection between the plates forming said compartments.

Accordingly, the invention is distinguished by the fact that the spacing between two adjacent compartments is provided by means of a spacer ring having a T-shaped cross-section, the side arms of the T being welded to the opposite edges of orifices formed in two parallel plates forming part of two adjacent compartments whilst the stem of the T is directed towards the exterior of the spacer ring and disposed between said plates. The interior of said spacer rings serves to provide a header for the low-pressure fluid which passes through the compartments whilst relative spacing between the plates within the space formed between the two compartments is ensured by means of spacer members fitted within said space, a tubular support being so arranged as to extend through all the spacer rings in order to serve as an internal support for said rings.

Preferably and in accordance with a further distinctive feature, the tubular support consists of a cylindrical tube which is provided with drilled holes for the flow of low-pressure fluid both inside and outside the compartments. The spacer rings are applied against the cylindrical tube by means of longitudinal cross-bars which are parallel to the axis of the tube and against which are applied radial studs fitted in the tube, the cross-bars and studs being disposed in uniformly spaced relation about the axis of the tube.

In accordance with a distinctive feature, the spacer members mounted within the space formed between two adjacent compartments are constituted by conical deformations die-stamped in each plate and adapted to come into contact with the opposite parallel plate. By way of alternative, said spacer members are constituted by lugs added to the external surface of the plates.

In accordance with a further distinctive feature, relative spacing of the two parallel plates which delimit each compartment is similarly achieved by means of spacing cones formed in each plate towards the interior of the compartment and adapted to cooperate with a depression formed in the other plate.

Further characteristic features of a heat exchanger as constructed in accordance with the invention will become apparent from the following description of an exemplified embodiment which is given by way of indication and not in any limiting sense, reference being made to the accompanying drawings, wherein:

FIG. 1 is a diagrammatic axial sectional view of a plate-type heat exchanger in accordance with the invention;

FIGS. 1*a* and 1*b* are part-sectional views to a smaller scale taken along line I—I of FIG. 1 and illustrating two alternative embodiments;

Figure 1:
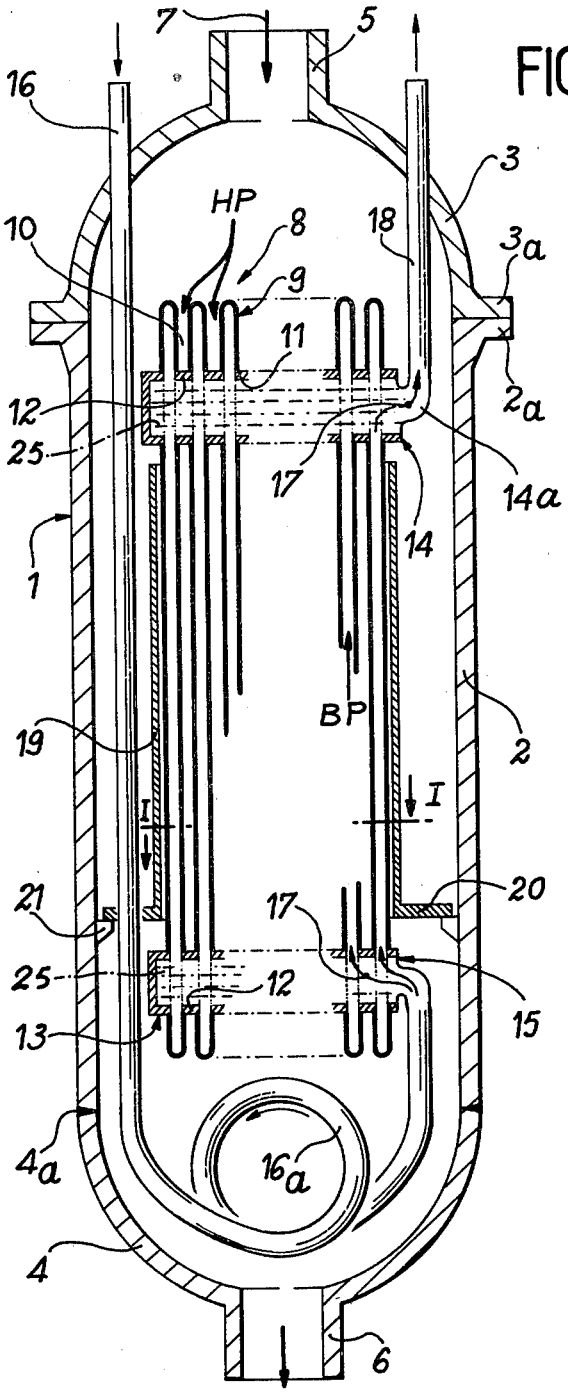
Figure 2:
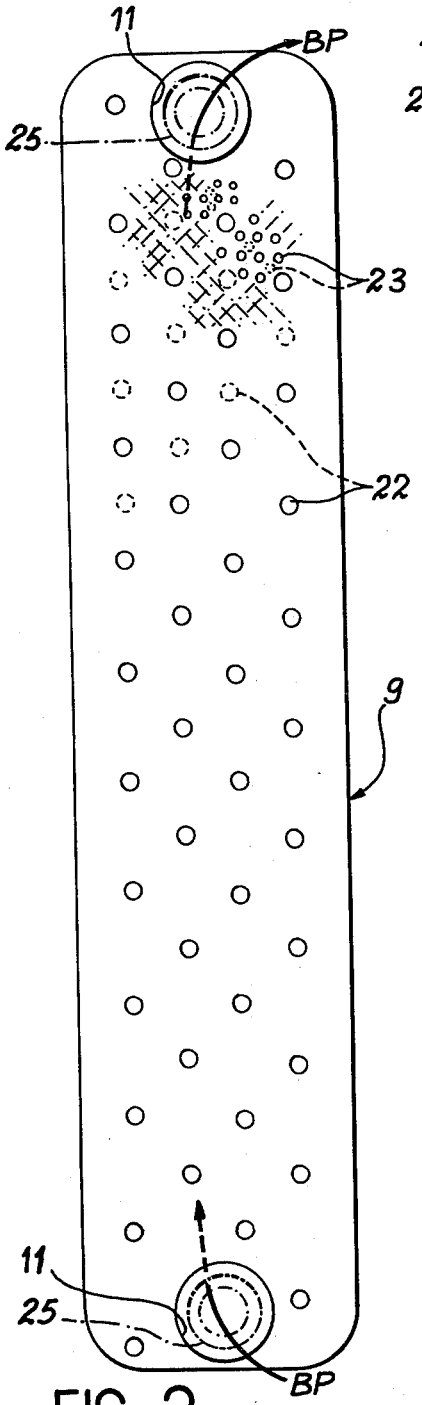
FIG. 2 is a front view to a larger scale and showing one of the plates of the heat exchanger in accordance with FIG. 1.

In the example of construction illustrated in FIG. 1, the heat exchanger under consideration mainly comprises a shell 1 formed by a lateral cylindrical wall 2 which is closed by two hemispherical ends, namely a top end-wall 3 which is joined to the upper end of the cylindrical wall by means of coupling flanges, and by a bottom end-wall 4 which is welded to the cylindrical wall at 4*a*. Provision is made in each end-wall for a nozzle designated respectively by the reference numerals 5 and 6. Depending on the direction of circulation which is indicated diagrammatically and by way of example by the arrows 7, the HP fluid is permitted to pass through the nozzles of the shell 1 in order to carry out heat exchange with the LP fluid within the shell. To this end, the heat exchanger comprises an assembly 8 of adjacent compartments 9 mounted within the shell 1 and separated from each other by spaces 10. Said compartments, the constructional detail of which will be explained hereinafter, are each constituted by means of two flat parallel plates which are welded together at their periphery, which have a generally rectangular shape but the profile of which could be different such as, for example, a lozenge shape or the like. Suitably disposed orifices 11 are formed especially in the vicinity of the small sides of said plates as shown in FIG. 2. Bracing of the compartments within the spaces 10 is carried out by means of spacer rings 12 (shown in FIG.

3) having a T-shaped cross-section and welded at 11 to the plates of said compartments opposite to the edges of orifices having corresponding dimensions which are formed in said plates. In this manner, two ducts 13 and 14 respectively are formed by the successive arrangement of the rings 12. Said ducts constitute inlet and outlet headers for the LP fluid which is capable of exchanging heat with the HP fluid across the surface of the plates of the compartments. The inlet header or duct 13 is supplied with LP fluid through a pipe 16 which penetrates one of the end-walls of the heat-exchanger shell and is connected to the header after forming a coil or expansion bend 16*a* which endows the pipe with a suitable degree of flexibility, especially with respect to thermal expansion stresses at the time of start-up and shutdown of the heat exchanger. The LP fluid then circulates in the direction of the arrows 17 within the interior of the compartments 9 in counterflow to the HP fluid which circulates externally of said compartments. Said LP fluid is collected at the outlet of the header 14 by means of an elbowed portion 14*a*, in another pipe 18 through which it is discharged from the heat exchanger to a utilization circuit (not shown in the drawings).

Figure 1A:
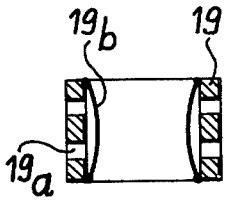
Figure 1B:
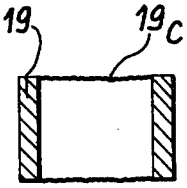

The compartments 9 are advantageously grouped together within a skirt 19 of rectangular cross-section which is open at the upper end and provided at the lower end with a flat flange 20. Said flange rests on an internal collar 21 formed in the heat-exchanger shell 2 in such a manner as to form with the wall of this latter a small clearance space which is intended to ensure relative leak-tightness. The skirt 19 is limited in height in order to surround the compartments 9 only in the central region while leaving the ends of these latter free. This accordingly ensures that suitable access or discharge can be provided for the HP fluid at the inlet or outlet of the skirt without resulting in excessive rates of flow in these zones. In another preferable arrangement, the lateral walls of the skirt 19 which extend parallel to the compartments 9 have a sufficient thickness to enable them to endow said compartments with a sufficient degree of mechanical strength at the time of transportation or handling operations. In accordance with the first alternative embodiment illustrated in FIG. 1*a*, the skirt 19 can be provided with perforations or drilled holes 19*a* and that surface of said skirt which is directed towards the compartments can be lined with flexible sheets 19*b*. In the second alternative embodiment illustrated in FIG. 1*b*, said skirt can be formed by solid walls assembled together laterally by means of two flexible corrugated sheets 19*c* which provide a connection between the opposite sides of the skirt on each side of the array 8 of compartments.

Figure 3:
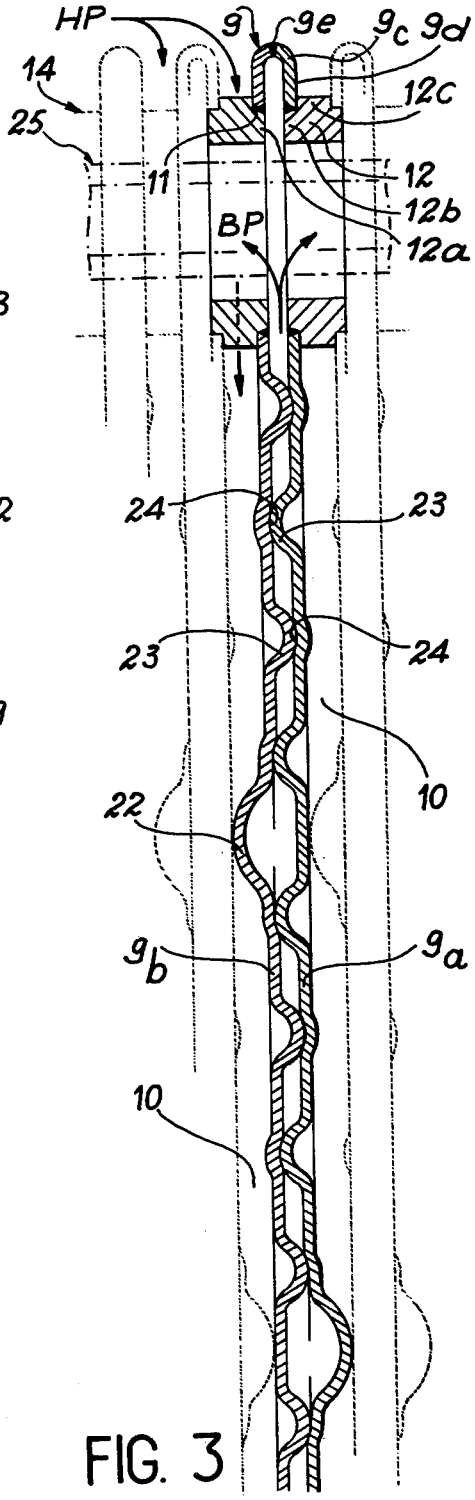
FIG. 3 is a transverse detail sectional view to an even larger scale showing a portion of the heat-exchanger compartments and illustrating in particular the coupling rings and the spacing means provided on the one hand between adjacent compartments and on the other hand between the plates of any one compartment.
Figure 4:
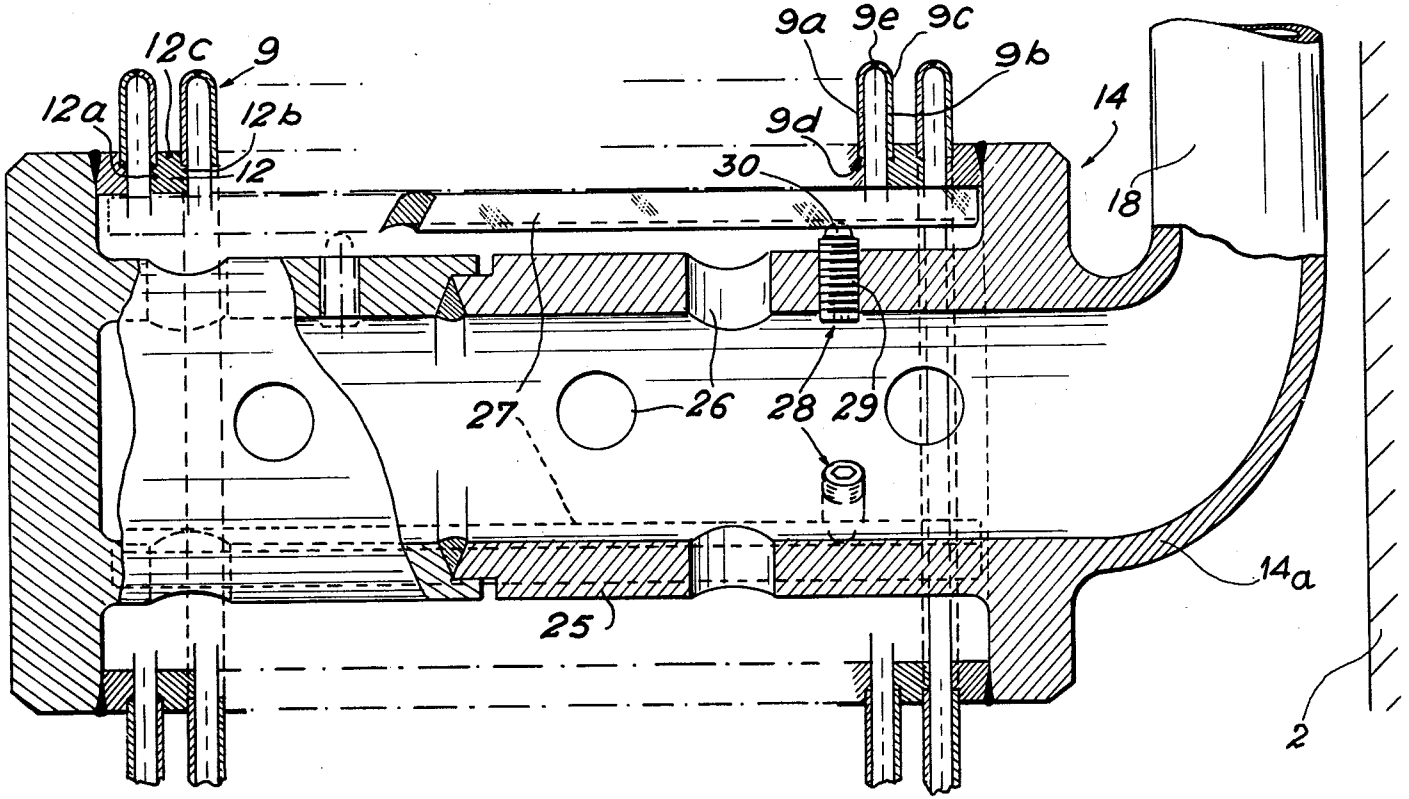
FIG. 4 is a sectional view to a larger scale and illustrating the tubular support provided for the coupling rings.

Reference will now be made more especially to FIGS. 2 and 3 in which the constructional detail of each heat-exchanger compartment 9 is shown by way of example. Each compartment is formed in particular by two flat parallel plates which are designated respectively by the references 9*a* and 9*b* and each provided at the periphery with an elbowed edge 9*c*. In a first step, each plate 9*a* or 9*b* is welded at 11 to a side arm of the T-section ring 12 with the stem of the T between the compartments along one of the lateral sides 12*a* or 12*b* respectively of this latter after engagement within the orifice 9*d* having a depth substantially equal to the thickness of the plate which is formed opposite to the plate and the diametral dimension of which corresponds to that of the outer edge of the corresponding side 12*a* or 12*b*. The central portion of the T or boss or stem 12*c* of each ring is thus placed between two plates 9*a* and 9*b* forming part of two successive compartments 9. The welded joint 9*e* between the plates 9*a* and 9*b* along the edges 9*c* in the case of each compartment is finally made in order to ensure continuity of the assembly. It should be noted that the particular shape adopted for the rings 12 permits easy execution and inspection of weld fillets 11; the profile of the rings also ensures effective and highly reliable assembly by virtue of the fact that the plates are applied against a lateral side wall as well as against the boss corresponding to the stem of the T-section of said ring.

The spacer rings 12 for bracing adjacent compartments thus constitute successively from one ring to the next the headers 13 and 14 for the admission and discharge of the low-pressure (LP) fluid which flows within said compartments. As can readily be understood, the very fact that the different compartments 9 are independent and that these latter are coupled together only by means of two rings 12 respectively at the level of the headers 13 and 14 exposes them during operation to the potential hazard of relative deformations arising from circulation of fluids, differences in temperatures, thermal or mechanical shocks, the action of gravity, and so forth. As a consequence, in order to provide a suitable support for the independent rings 12 and to improve the rigidity of the assembly as a whole, another distinctive feature of the invention consists in making provision within the headers 13 and 14 and through the rings 12 for a cylindrical tube 25 which is pierced by holes 26 for the passage of the low-pressure fluid. Said tube is connected to the admission or discharge pipes 16 or 18 as the case may be. The spacer rings 12 are also associated with cross-bars 27 which are parallel to the axis of the cylindrical tube 25, which are applied on said spacer rings said cross-bars being adapted to cooperate with studs 28 mounted radially in the surface of the cylindrical tube. The cross-bars and the studs are uniformly distributed about the axis of the tube, in particular at angular intervals of 120° with respect to each other. Moreover, the studs 28 can be designed in the form of elements which are partially threaded at 29 and cooperate with internally-threaded bores formed in the tube in order to permit adjustment of the distance between said holes and the cross-bars; each stud has a spherical tip 30 which is applied against a cross-bar.

Bracing of the compartments within the spaces 10 formed between these latter is also achieved by making provision in the plates 9*a* and 9*b* at predetermined locations for raised spacing bosses or cones 22 directed within the spaces 10, each cone being applied against the opposite plate of the adjacent compartment. The number of cones 22 is chosen as a function of predictable transient operating regimes of the heat exchanger since such transient conditions are liable to produce a more or less substantial reversal of the pressure difference between the two fluids. Under normal operating conditions, the cones 22 of any one plate remain in contact with the opposite plate since the complete assembly of plates is surrounded by the HP fluid at its inlet pressure. By reason of pressure drops, said inlet pressure is of slightly higher value than the pressure which prevails within the spaces 10 between compartments. The corresponding pressure difference is transmitted to the different compartments at successive points by virtue of the flexibility of the skirt 19, this flexibility being obtained by employing either of the alternative embodiments illustrated in FIGS 1*a* and 1*b*. Suitable bracing of the internal region of the compartments 9 is also achieved by forming additional bosses 23 in each plate 9*a* and 9*b*. Said bosses 23 are directed towards the interior of the compartments and intended to cooperate with depressions 24 formed in the oppositely-facing parallel plates. The presence of said depressions for receiving the spacing cones of the parallel plate plays a significant part in improving the general rigidity of the compartments and ensures a sufficiently large contact area for better stress distribution.

In accordance with the invention, the width of the spaces through which the HP fluid circulates between adjacent compartments can therefore be adjusted at will independently of the width of said compartments. This facilitates large-scale manufacture and makes it possible to ensure better optimization of the heat exchanger according to its intended use.

By virtue of the special design of the skirt 19, the invention also makes it possible to ensure good mechanical strength of all the compartments, either during operation of the heat exchanger or during transportation or handling of this latter.

As can readily be understood, the invention is not limited to the constructional example described in the foregoing with reference to the drawings but extends on the contrary to all alternative forms. In particular, it is clearly apparent that the arrangements provided by the invention do not imply any basic assumptions in regard to the particular relative assembly of the compartments and to the relative arrangement of the headers when the compartments are assembled together in groups in the manner described and claimed in U.S. patent application Ser. No. 786,561 filed on Apr. 11, 1977, now abandoned.

Similarly, it is self-evident that the shape of the spacer rings could be modified and could in particular be given a more highly accentuated T-shape than that illustrated in the drawings. A larger contact area would thus be provided between compartments for the connection established at the level of the orifices for admission or discharge of the LP fluid. Moreover, the spacing cones between the compartment plates within the spaces provided for the circulation of the HP fluid could be replaced by studs or the like which are separately fixed on the external surface of said plates.

What we claim is:

1. A plate-type heat exchanger comprising a plurality of flat parallel compartments each delimited between two adjacent plates and separated by narrow spaces, a first fluid being circulated within said narrow spaces during normal operation in order to exchange heat across said plates with a second fluid which flows through said compartments, wherein the spacing between two adjacent compartments is provided by means of a spacer ring having a T-shaped cross-section, said cross-section being provided with two side arms and a stem, each spacing ring being located between two plates belonging to two adjacent compartments, the side arms of the T being engaged in and welded to the edges of opposite orifices formed in two parallel plates forming part of two adjacent compartments, the stem of the T being directed towards the exterior of said spacer ring and disposed between said plates, said orifices having edges on which said arms are welded, the lengths of said side arms being substantially equal to the thickness of a plate, the interior of said spacer rings forming a passage between two adjacent compartments, the association of said spacer rings forming a header for the second fluid which passes through the compartments, the spacing between the plates within the space formed between the two compartments being further ensured by spacer members within said space, and a tubular support extending through all the spacer rings forming an internal support for said rings.

2. A plate exchanger according to claim 1, wherein the tubular support consists of a cylindrical tube provided with drilled holes for the flow of low-pressure fluid inside and outside the compartments, the spacer rings being applied against said cylindrical tube by means of longitudinal cross-bars which are parallel to the axis of the cylindrical tube and against which are applied radial studs fitted in said tube, said cross-bars and said studs being disposed in uniformly spaced relation about the axis of said tube.

3. A plate exchanger according to claim 2, wherein the radial studs each have a threaded portion for adjusting the length thereof by screwing within internally-threaded bores formed in the cylindrical tube.

4. A plate exchanger according to claim 2, wherein the studs are each provided with a spherical tip for bearing on the longitudinal cross-bars.

5. A plate exchanger according to claim 1, wherein the compartments are surrounded by an open-topped skirt having a generally rectangular cross-section and provided at the lower end with a flat flange adapted to rest on an internal collar formed in the surface of an outer shell through which the high-pressure fluid passes.

6. A plate exchanger according to claim 5, wherein the skirt which surrounds the compartments has two perforated walls parallel to said compartments and the surfaces of said skirt which are directed towards said compartments are lined with flexible sheets.

7. A plate exchanger according to claim 5, wherein the skirt which surrounds the compartments has two solid walls which are parallel to said compartments and joined to each other by means of two corrugated flexible sheets.

8. A plate exchanger according to claim 1, wherein the spacer members mounted within the space formed between two adjacent compartments are constituted by die-stamped in each plate and adapted to come into contact with the opposite parallel plate.

9. A plate exchanger according to claim 1, wherein relative spacing of the two parallel plates which delimit each compartment is achieved by means of spacing bosses formed in each plate aforesaid towards the interior of the compartment and adapted to cooperate with a depression formed in the other plate.

* * * * *